United States Patent [19]

Grant

[11] 4,207,125

[45] Jun. 10, 1980

[54] PRE-MIX FOR EXPLOSIVE COMPOSITION AND METHOD

[75] Inventor: Charles H. Grant, Tower, Minn.

[73] Assignee: Energy Sciences and Consultants, Inc., Biwabik, Minn.

[21] Appl. No.: 931,485

[22] Filed: Aug. 7, 1978

[51] Int. Cl.[2] ..... C06B 23/00

[52] U.S. Cl. ..... 149/109.4; 149/44; 149/60; 149/61; 149/76; 149/83; 149/109.6

[58] Field of Search ..... 149/61, 76, 46, 83, 149/60, 109.4, 109.6

[56] References Cited

U.S. PATENT DOCUMENTS 3,925,123 12/1975 Jessop ..... 149/61 X

*Primary Examiner*—Stephen J. Lechert, Jr.

*Attorney, Agent, or Firm*—Trexler, Wolters, Bushnell & Fosse, Ltd.

[57] ABSTRACT

A method and composition are provided for preparing slurry explosive formulations characterized in containing separate liquid and particulate phases. The liquid phase is a detonation insensitive paste-like pre-mix composition having an extended shelf life and being adapted for ultimate combination with sufficient particulate material to form an efficient explosive. The pre-mix composition includes a gum or thickener but is not gelled or cross-linked, in order to facilitate ultimate on-site mixing in a rapid manner and without the need for complex equipment.

12 Claims, No Drawings

PRE-MIX FOR EXPLOSIVE COMPOSITION AND METHOD

BACKGROUND OF THE INVENTION

Slurry explosive compositions have been known heretofore and are disclosed, for example, in U.S. Pat. Nos. 2,992,912; 3,091,559; 3,094,443; 3,287,189; and 3,475,238. These compositions are of the general type which comprises a particulate solid phase and a separate liquid phase intimately mixed with the solid phase. The liquid phase includes a thickening agent such as a synthetic or natural gum which is hydrated and gelled so as to maintain a desired, even distribution of the particulate solid phase throughout the liquid phase and also to provide the explosive composition with resistance to connate water in the bore hole. As suggested in the aforementioned U.S. Pat. No. 3,475,238 and in U.S. Pat. No. 3,737,350, prior art compositions are formulated such that, when the liquid phase is initially prepared, gelling or cross-linking tends to occur shortly thereafter, usually within a few days, so that subsequent mixing with the particulate solid phase is difficult, time consuming and requires sophisticated mixing equipment. Thus, in U.S. Pat. No. 3,475,238, it was taught that the gelling or cross-linking process could be extended from a few days up to about thirty days or more; and even if cross-linking had taken place, the gel could be broken down by the addition of sufficient acid to adjust the pH to an acidic range. This procedure allowed more time in which to accomplish mixing of the liquid phase with the particulate solid phase. After such mixing, the material could be relatively rapidly gelled by the addition of a cross-linking agent.

In U.S. Pat. Nos. 3,094,443 and 3,091,559, compositions are presented in which the liquid phase contains substantial amounts of either aqueous ammoniacal solutions or anhydrous liquid ammonia. These latter materials require that mixing be accomplished at a facility which is equipped to store and process volatile compounds. Thus, in U.S. Pat. No. 3,091,559 it was taught that the explosive composition be poured into polyethylene plastic bags which were ultimately transported to the detonation site. Similarly, in U.S. Pat. No. 3,094,443 the explosive compositions were thickened or gelled in order to reduce the loss of ammonia vapor and render the composition less noxious in handling.

Gelling or cross-linking of the explosive composition at a mixing plant, as suggested in the aforementioned patents, renders the use of the composition difficult if not impossible to use where it is desirable to retain the option of deactivating the explosive composition by flushing out the soluble components with an excess of water. In contrast to the prior art, the present invention contemplates a novel pre-mix liquid phase composition and method of preparing a slurry explosive which are eminently suitable for mining and other industrial uses as well as for certain military applications where transportation and storage of materials are of special significance. The present compositions are also highly useful where it is desired to have the capability of storing slurry explosive composition materials safely and without fear of explosion and for long periods of time, on the order of months or even years, prior to ultimate use. Furthermore, it is desired that the slurry explosive composition be such that ingredients can be easily and quickly mixed at the site of intended use without the need for sophisticated mixing equipment.

It is an object of the present invention to provide a novel method for preparing a slurry explosive whereby the sophisticated elements and complex agitation thereof are incorporated in a pre-mixed liquid phase so that sufficient particulate material can be added to produce a finished explosive product by simple on-site mixing.

It is another object of the invention to provide a detonation insensitive liquid pre-mix capable of being safely stored for periods of at least a year without gelling or cross-linking and adapted ultimately to be mixed with particulate fuels and oxidizers to produce a slurry explosive.

An additional object of the invention is to provide a novel pre-mix composition whereby a slurry explosive which produces a detonation of usable magnitude and force may be mixed from stable components at the point of use without the need for complex mixing techniques.

A still further object of the invention is to provide an easily mixed slurry explosive composition which is highly viscous yet displays no cross-linking so that it may be easily rendered inactive by the addition of an excess of water, or may be catalytically cross-linked at the point of use to allow its use in bore holes containing connate water.

Other objects and advantages of the invention will become apparent to one skilled in the art upon becoming familiar with the following description and claims.

SUMMARY OF THE INVENTION

In accordance with the present invention, a highly viscous or a paste-like liquid phase concentrate for use in a slurry explosive is prepared under closely controlled conditions by mixing together the desired ingredients of the liquid phase and a thickening agent such as a natural or synthetic gum having the characteristic of being hydratable in the composition without cross-linking or gelling even after standing for extended periods of time. This pre-mix composition is nonexplosive and can be safely shipped and stored for long periods of time without special precautions. Material for the particulate solid phases may include salts such as ammonium nitrate and metals such as aluminum, which particulate materials are nonexplosive and are capable of being shipped and stored safely for long periods of time. When it is desired to use the slurry explosive composition, the liquid phase pre-mix composition and the particulate materials are removed from storage and mixed at the blasting site for prompt loading into a bore hole or the like. Since, as indicated, the pre-mix liquid composition is not cross-linked or gelled, proper and rapid mixing with the particulate phase materials can be easily accomplished without the aid of sophisticated mixing equipment which would otherwise be required if the pre-mix were gelled. For example, the explosive slurry composition of the present invention can be mixed in an ordinary cement mixing machine. The high viscosity or paste-like nature of the liquid phase pre-mix concentrate provides a slurry composition having reasonable resistance to the influx of water in a bore hole; but at the same time, the fact that the thickening agent is not gelled or cross-linked enables the explosive composition to be deactivated simply by flushing it out with excess water.

If, at the time of on-site mixing, it is determined that a water impervious explosive composition is desired, a cross-linking catalyst or chemical agent may be added to the final mix to cause the explosive composition to gel after the particulate and liquid phases have been intimately combined.

DETAILED DESCRIPTION OF THE INVENTION

In the practice of the present method, a pre-mix composition is prepared in the following manner. A specific quantity of an inorganic oxidizing salt is dissolved in water, alone or in the presence of other constituents such as, for example, bubble anti-coalescing agents, thickening agents which are not self cross-linking in said composition, and liquid organic fluid extenders.

Examples of the inorganic oxidizing salt include ammonium, alkali metal and alkaline earth metal nitrates, chlorates, perchlorates, peroxides, sulfates or any other oxidizer known to oxidize in an explosive reaction. Specific examples of typical oxidizers are ammonium nitrate, sodium nitrate, calcium nitrate, sodium perchlorate, potassium perchlorate and the like. Preferably, sodium nitrate is employed wherein the sodium nitrate ranges from 10% to 50% by weight of the pre-mix composition.

Liquid organic fluid extenders which are ordinarily employed in the present invention and other explosive slurries are those having a favorable carbon-oxygen ratio such that there is no detrimental competitor of the carbon with the fuel for oxygen in the ultimate explosive reaction. Monohydroxy alkanols containing one to four carbon atoms, ethylene and diethylene glycol, propylene glycol, glycerol, and formamide are used to effect optimal consistency and to depress the freezing point of slurry explosive compositions. Preferably, diethylene glycol is employed wherein the diethylene glycol ranges from 0% to 20% by weight of the pre-mix composition.

Examples of thickening agents which do not gel or cross-link in the present pre-mix composition yet may be induced to gel or cross-link upon use of the pre-mix in the ultimate explosive mixture are naturally occurring high molecular weight polysaccharides or synthetic polyacrylamides having a molecular weight ranging from 1 to about 25. Of these, thickeners derived from galactomannons and particularly guar gum are preferred because of their ready availability and compatability with slurry explosives of this type.

Many thickeners, including the galactomannons, are particularly sensitive to the pH level of the composition in which they are used. These substances hydrate thereby increasing the viscosity of the aggregate without gelling at a pH of less than 7.0, yet have a tendency to form a cross-linked semi-solid mass in alkaline compositions. Thus, in the present invention it is important to include in the pre-mix sufficient quantity of a strong acid such as sulfamic acid to ensure a pH of less than 7.0.

Thickeners and suitable means for cross-linking the ultimate explosive aggregation composition are known in the art. For example, the explosive may be cross-linked by adjusting the pH of the slurry to the basic range or by the addition of antimony (III) oxide or polyvalent ions including chromate, borate, ferric ions and the like.

Also included in the pre-mix composition may be a bubble stabilizer which produces and preserves small gas bubbles upon the mixing of the final explosive aggregate. Amphoteric surfactants such as salts of N-alkyl-beta-amino-proprionic acid or N-alkyl-beta-imino-diproprionic acid will prevent small bubbles from coalescing.

Optionally, other constituents can also be employed in the pre-mix of the present invention. For example, any rapidly combustible substance known to fuel explosives may be included to increase the detonation sensitivity of the final explosive where such substance is not in itself an explosive. Various preservatives and corrosion inhibitors may be incorporated into the pre-mix to restrict decomposition of the components and to reduce the corrosion of the particulate metal which may ultimately be added to form the final explosive. Examples of such inhibitors include mannitol and various ammonium and alkali metal phosphates.

Subsequent to mixing, the pre-mix composition may be pumped or poured from the processing equipment and safely stored in suitable containers such as polyethylene or metal cans or drums.

At the site of intended use, the liquid pre-mix phase is combined with appropriate particulate material known in the art to produce a slurry explosive. Examples of such material include inorganic oxidizing salts, particulate metals which oxidize in an explosive reaction, or combinations thereof. Specific examples include granulated or prilled ammonium nitrate and aluminum or magnesium metal of a particle size ranging from 4 to 200 mesh. Preferably, prilled ammonium nitrate is employed wherein the ammonium nitrate ranges from 60% to 80% by weight of the final composition. However, if additional blasting force is required, a combination of prilled ammonium nitrate and particulate aluminum may be selected wherein the ammonium nitrate ranges from 40% to 70% and the particulate aluminum ranges from 3% to 30% by weight of the final composition.

The final mixing may be performed by agitation in simple, portable equipment such as a small bakery mixer or cement mixer for a period of from 1 to 5 minutes.

EXAMPLE 1

A 100 pound batch of the present pre-mix was prepared as follows. A heated solution was prepared containing 8 parts by weight sodium nitrate, 0.05 parts by weight mannitol, 0.015 parts by weight sulfamic acid, and 15 parts by weight water. The solution was mechanically mixed using a turbine mixer for 5 minutes. (Parts by weight as used in this example are based on the total batch of the pre-mix product) 0.15 parts by weight bubble anti-coalescing agent sodium N-lauryl beta iminodiproprionate, sold under the trademark Deriphat 160-C, was added thereto and the mixture agitated for an additional two minutes. Thereafter, 1 part by weight derivitized guar gum (Stein-Hall HP-8) dispersed in 4 parts by weight diethylene glycol was added to the mixture and agitated for a further period of 2 minutes to provide a substantially homogeneous mass.

The resulting substance was thick and paste-like but flowable having a density of about 1.3 grams per cubic centimeter and a pH of 7.0. The mixture displayed no cross-linking or thickening and was poured into 3 to 30 pound bags for storage.

The resulting pre-mix composition was subjected to repeated detonation attempts using nitrated high explosive detonating devices such as pentolite, TNT, and PETN all of which failed to produce an explosive reaction using the pre-mix alone.

After 35 days of storage at room temperature 6 pounds of the pre-mix composition, which remained in a flowable form with no evidence of cross-linking or thickening, was combined with 10 pounds prilled ammonium nitrate and agitated for 1½ minutes in a bakery mixer. This was followed by the addition of 4 pounds of particulate aluminum substantially of a particle size of +100 mesh and a thickness of 0.25 mils (Reynolds HPS-10) and the resulting mixture was agitated for 5 minutes to a density of 1.10 grams per cubic centimeter. The resulting slurry was poured into a metal can and detonated with a pentolite charge the following day.

EXAMPLE 2

A portion of the pre-mix composition prepared in Example 1 was stored for 35 days in a cold room which was at a temperature of −6° Centrigrade at the time of use yet showed no evidence of cross-linking or thickening. This pre-mix was used to prepare an explosive composition in accordance with the procedure described and using the components set forth in Example 1 and similar results were obtained.

EXAMPLE 3

The pre-mix prepared in Example 1 was examined after 65 days of storage and found to remain flowable with no evidence of cross-linking or thickening. Six pounds of this pre-mix was added to six pounds of particulate aluminum (Alcoa 1620), 8 pounds prilled ammonium nitrate and 7.26 grams antimony trioxide in a (bakery) mixer and agitated as the particulate matter was dispersed throughout the mass. The composition remained flowable until 54 grams of an aqueous solution containing 12½ ammonia was added thereto whereupon the mixture immediately cross-linked to a water impervious rubber-like consistency with a specific gravity of 1.319. The resulting mass was effectively detonated 10 days later using a pentolite charge.

EXAMPLE 4

The pre-mix in Example 1 was examined after 287 days of storage and found to be flowable and free from cross-linking. First, 7.5 pounds of the pre-mix was combined with 6.25 pounds of prilled ammonium nitrate and agitated for 30 seconds in a bakery mixer. Then 5.25 pounds of particulate aluminum (2.75 pounds Alcoa VFN and 2.25 pounds Alcoa 1600) and an additional 6.25 pounds prilled ammonium nitrate were added and the mixture was agitated for 1 additional minute. The resultant slurry explosive was effectively detonated 2 days later using a pentolite charge.

EXAMPLE 5

An additional batch of the present pre-mix was prepared as follows. A heated solution was prepared containing 4 parts by weight sodium nitrate, 0.025 parts by weight mannitol, 0.015 parts by weight sulfamic acid, 1 part by weight gilsonite fuel, and 5.25 parts by weight water (parts by weight as used in this example are based on the total batch of the pre-mix product). The solution was mechanically mixed for 5 minutes using a turbine mixer. 0.15 parts by weight bubble anti-coalescing agent sodium N-lauryl beta iminodiproprionate, sold under the trademark Deriphat D 160-C was added and the mixture agitated for an additional two minutes. Thereafter, 0.15 parts by weight derivitized guar gum (Stein-Hall HP-8) and 0.05 parts by weight synthetic polyacrylamide (Polyhall gum) dispersed in 2.5 parts by weight diethylene glycol was added to the mixture and agitated for a further period of 2 minutes to provide a substantially homogeneous mass.

The resulting substance was paste-like but flowable and was poured into suitable containers for storage. Thereafter, the pre-mix composition was transported to the explosion site where a slurry explosive made up of 26% by weight pre-mix and 74% by weight prilled ammonium nitrate was mixed in a cement mixer for a period of 5 minutes. 0.04% by weight antimony trioxide was then added whereupon the slurry cross-linked and formed a water impervious rubbery mass. This resultant composition was detonated using a pentolite charge.

The following is claimed as invention:

1. A method of preparing slurry explosive compositions containing distinct, liquid and particulate phases, which method comprises the steps of: compounding at a first location remote from a site of possible use, a long term storable non-explosive detonation insensitive liquid phase pre-mix having a stable viscosity; subsequently transporting said pre-mix to a second location in the vicinity of the site of possible use; and subsequently dispersing at said second location the particulate phase into said liquid phase by simple mechanical mixing techniques and thereby forming a slurry explosive mixture in the vicinity of the site of composition use.

2. The method according to claim 1 which further comprises the steps of: incorporating in said nonexplosive liquid phase at said first location a selectively cross-linkable but non-self cross-linking thickening agent, whereby to permit water impervious slurry explosive mixtures to be prepared on site.

3. A method for preparing a slurry explosive by the combination of nonexplosive pre-mix compositions with particulate explosive agents which method comprises: (a) forming a non-explosive pre-mix composition by dissolving in water an inorganic oxidizing salt known to oxidize in an explosive reaction, the amount of said salt ranging from 10–50% by weight of the pre-mix composition, adding a material selected from the group consisting of non-self cross-linking thickeners, the amount of said thickener ranging from 0.5 to about 2.0% by weight of the pre-mix composition; and (b) adding to the resultant pre-mix composition a particulate inorganic oxidizing salt, the amount of said salt ranging from 250 to 350% by weight of the pre-mix composition and thereby forming a slurry explosive.

4. The method in claim 3 which further comprises the step of adding to said resultant pre-mix solution prior to step (b) a liquid organic fluid extender, the amount of said fluid extender ranging up to about 20% by weight of said pre-mix composition.

5. The method in claim 3 which further comprises the step of adding to the resultant slurry explosive composition a cross-linking agent whereby to permit said slurry explosive composition to cross-link to a water impervious gelled consistency.

6. A non-explosive detonation insensitive storeable non-gelled thick liquid phase pre-mix composition with comparatively stable viscosity for subsequent use in preparing a slurried explosive upon being combined with additional material, which pre-mix composition comprises, on a weight basis: (a) from about 30% to 50% water, (b) from about 10% to 50% of an inorganic oxidizing salt, (c) up to about 20% of a liquid, organic fluid extender, (d) from about 0.5% to about 2.0% of a thickening agent consisting essentially of a non-self cross-linking thickener, said composition being free of any self cross-linking thickener.

7. The composition according to claim 6 which further includes from about 0.5% to about 1.5% of an organic bubble anti-coalescing agent.

8. The composition according to claim 6 which further includes from about 0.5% to 1.5% decomposition and metal reaction inhibitor.

9. A non-explosive detonation insensitive storeable non-gelled thick liquid phase pre-mix composition of comparatively stable viscosity for subsequent use in preparing a slurried explosive upon being combined with additional material, which pre-mix composition consists essentially of, on a weight basis: (a) about 40% water, (b) about 32% (sodium nitrate) inorganic oxidizing salt, (c) up to about 20% diethylene glycol, (d) about 1.5% guar gum.

10. The composition according to claim 9 which further includes about 0.5% sodium N-lauryl beta iminodiproprionate.

11. The composition according to claim 9 which further includes about 0.05% mannitol.

12. A non-explosive detonation insensitive storeable non-gelled thick liquid phase pre-mix composition with comparatively stable viscosity for subsequent use in preparing a slurried explosive upon being combined with additional material, which pre-mix composition consists essentially of, on a weight basis: (a) from about 30% to 50% water, (b) from about 10% to about 50% of an inorganic oxidizing salt, (c) up to about 20% of a liquid, organic fluid extender, (d) from about 0.5% to about 2.0% of a non-self cross-linking thickener.

* * * * *

UNITED STATES PATENT AND TRADEMARK OFFICE

CERTIFICATE OF CORRECTION

PATENT NO. : 4,207,125

DATED : June 10, 1980

INVENTOR(S) : CHARLES H. GRANT

It is certified that error appears in the above-identified patent and that said Letters Patent are hereby corrected as shown below:

Column 5, line 33, add "% " after --12½--;

Column 7, line 15, cancel "(sodium nitrate)".

Signed and Sealed this

*Twenty-first* Day of *October 1980*

[SEAL]

*Attest:*

SIDNEY A. DIAMOND

*Attesting Officer*

*Commissioner of Patents and Trademarks*